United States Patent [19]

MacArthur

[11] Patent Number: 4,726,714

[45] Date of Patent: Feb. 23, 1988

[54] SELF ADJUSTING STRUCTURE SUPPORT

[76] Inventor: Eugene D. MacArthur, 5072 Ray Ave., Castro Valley, Calif. 94546

[21] Appl. No.: 720,369

[22] Filed: Apr. 5, 1985

[51] Int. Cl.[4] ..... E21D 15/44

[52] U.S. Cl. ..... 405/290; 248/354.2

[58] Field of Search ..... 405/290, 288; 248/354.1, 354.2, 351

[56] References Cited

U.S. PATENT DOCUMENTS

| | | | |
|---|---|---|---|
| 804,696 | 11/1905 | Winterhoff | 405/290 |
| 1,765,200 | 6/1930 | Bullough | 405/290 |
| 2,510,688 | 6/1950 | Evans et al. | 405/290 |
| 4,167,361 | 9/1979 | Petro et al. | 405/290 |

FOREIGN PATENT DOCUMENTS

| | | | |
|---|---|---|---|
| 2125173 | 12/1971 | Fed. Rep. of Germany | 405/288 |
| 2070666 | 9/1981 | United Kingdom | 405/290 |

*Primary Examiner*—Randolph A. Reese
*Assistant Examiner*—Peter M. Cuomo
*Attorney, Agent, or Firm*—Glen R. Grunewald; Thomas R. Lampe

[57] ABSTRACT

A self-adjusting support or structure including a cylindrical column having a top portion attachable to the structure and having a bearing plate partly closing the bottom with the column nesting within a casing that stands on the ground, the column being adapted to receive sand in its hollow interior, the column having spacing projections around its lower portion and the casing having spacing projections around its upper portions so that sand can flow into the casing beneath the bearing plate when the casing settles to a lower elevation.

4 Claims, 2 Drawing Figures

SELF ADJUSTING STRUCTURE SUPPORT

BACKGROUND OF THE INVENTION

Structures that are to be held both level and above the ground may be set on continuous foundations such as poured concrete. Many structures are supported on columns which in turn are held on piers.

Piers are frequently in the form of concrete bases with large lower surfaces to engage the earth and upper surfaces on which columns of wood or steel may be set. A typical pier is a concrete truncated pyramid having a wooden plate set in it to which wooden columns such as four by fours are fixed. Variations in the grade of the earth above which a structure is supported can be accomodated by making the columns different lengths so that tops of all columns lie in the same horizontal plane.

When a group of piers and columns is used to support a structure there are problems in maintaining the tops of all columns in the same horizontal plane. In the first instance it is necessary to cut each column to be exactly the correct length even though each column may have a different length from each other column because the supporting piers are at different elevations. Cutting columns to be exactly the correct length is so difficult that it is substantially never accomplished correctly and small variations from the exact length required are adjusted by the use of shims between the top of a column and the supported structure.

Even after all columns and piers are properly in place and the structure is supported evenly above the earth, the earth on which the piers are set may yield because of the load applied, settling of back-fill, or for other reasons. Settling typically occurs beneath all structures and when some of the supporting elements settle and others do not, or when different supporting elements settle to different degrees it will cause some of the columns supporting the structure to carry more than their share of the load and in extreme cases other columns will carry no load at all. If some columns carry a small load or no load the beam span between columns becomes too long and eventually the beam sags causing undesirable effects of settling such as floors that are not horizontal, door and windows that do not function properly and cracks in ceilings and walls.

When a structure has been built and settling begins after a number of years the crawl space beneath the structure can be entered and those columns that have receded can be made useful again by employing shims between the column tops and the supporting structure. If further settling occurs the shimming process is repeated.

Self-adjusting supports have been used to avoid the problems mentioned above. Among the self-adusting supports that have been used are those in which the supporting columns are fixed to the structure they support and their bottoms are set in casings which surround the column bottoms. The casings include ground bearing elements and they surround the supporting columns and are filled or partially filled with flowable ganular material such as sand. When the earth settles beneath such a casing the casing may settle to a lower elevation but the column cannot because its top is connected to the supported structure. As the casing moves to a lower elevation sand between the casing and the column flows beneath the column thereby maintaining the casing in a supporting relationship with the column. Vibrations and flexing of the beams supported by the column cause the sand to flow to a position where firm support is maintained.

The problems found with devices such as those described above are that they must maintain a large space between the column and the casing to provide adequate inventory of sand and the sand inventory must be replenished periodically. The large space also permits the column to become nonvertical within the casing so that the load is supported by a column having a less than optimum orientation. In addition, some of the casings are exposed to the weather so that the sand inventory within them may become damp and less adapted to flow beneath the bearing surface of a column at or near the bottom of the casing.

SUMMARY OF THE INVENTION

This invention is a self-adjusting support for a structure that functions on the principle of adjusting the length of the support by having sand flow into a casing beneath the bearing surface of a column that is fixed to the structure that it is supporting. In the self-adjusting support of this invention the column is a hollow cylinder, typically a large diameter pipe, which has a plate fixed to its top that is adapted for being connected to the structure being supported, for example by being screwed to a wood beam. The column also has a bearing plate that partially closes the bottom of the cylindrical column. The plate acts as a bearing plate to support the load borne by the column against the sand in the bottom of the casing surrounding the column.

The casing is also cylindrical and has a ground bearing plate at its bottom. The ground engaging plate is preferably flat or at least having a planar configuration and it preferably is provided with drain holes that are positioned to drain water from the cylindrical part of the casing and are too small to provide a significant flow of sand from the casing. The cylindrical part of the casing is perpendicular to the ground engaging plate that it is connected to and it is provided, preferably around its upper rim, with spacing projections which project inwardly toward the outer cylindrical surface of the column. The column also is provided, preferably around its bottom opening, with spacing projections that project outwardly toward the inner cylindrical surface of the casing. The projections from each element are large enough to almost contact the other element and they thereby maintain the casing and the column concentric and vertical.

Although it is preferred for the column to have cylindrical walls thick enough to support any load the column is to bear, the column may also be provided with internal supporting elements for additional shape or strength factors so that the column will be adequate to support any load regardless of its length. For example, the cylindrical portion of the column may surround a supporting element such as an I beam which is long enough to extend from the connecting plate to the bearing plate. The I beam or other additional supporting element can occupy the hollow interior of the cylindrical portion of the column without it interferring in any way with the functioning of the column as will be described in more detail hereinafter.

DETAILED DESCRIPTION OF THE DRAWINGS

Figure 1:
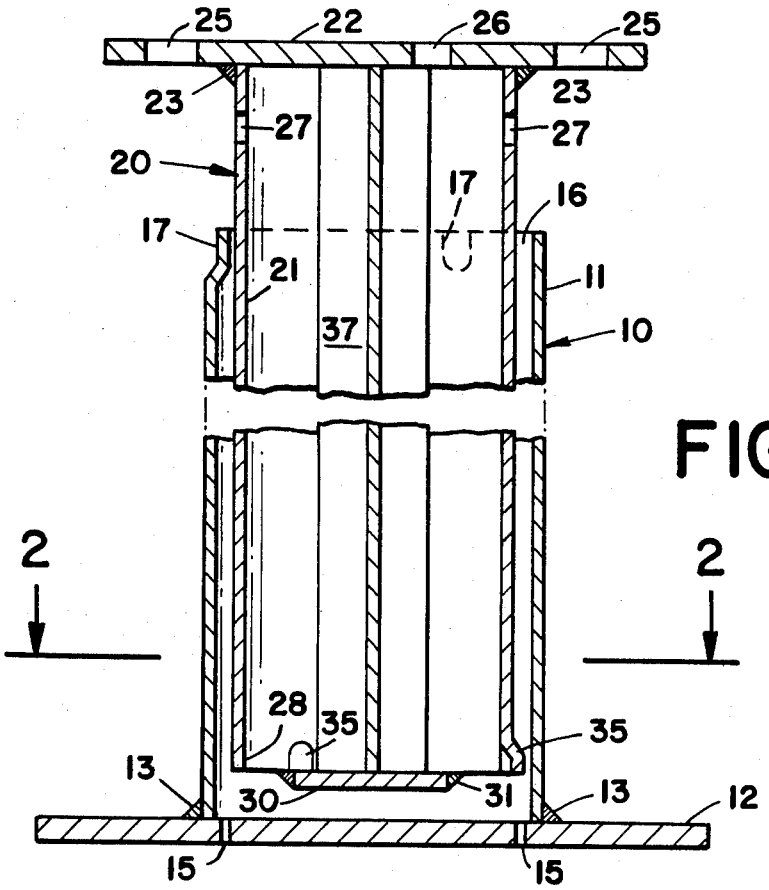
FIG. 1 is a partial elevation cross-section of a device embodying this invention.

In the embodiment illustrated in the drawings the casing portion of the structure is generally designated 10. The casing includes a cylindrical part 11 to which a ground engaging element 12 is welded through weld 13. The ground enaging element is provided with a number of drain holes 15 through which water may be removed from the interior of the casing. The casing also includes an upper opening 16 which is provided with at least three inwardly extending projections 17.

The device also includes a column generally designated 20 that has a cylindrical portion 21 and a structure engaging portion 22 welded to the upper opening of the cylindrical portion 22 through weld 23. The structure engaging part 22 is provided with holes 25 for screws or other fasteners to connect it to the structure that is to be supported and a hole 26 through which sand or other flowable granular material may be inroduced into the interior of cylindrical part 21. The cylindrical part 21 may also be provided with holes 27 for introducing sand or flowable material to its interior. The column 20 is provided with a bottom opening 28 which is partially closed by a bearing plate 30 that is connected to the lower cylindrical opening 28 through welds 31. The lower opening 38 is provided with three outwardly extending projection 35 which project closely adjacent to the interior wall of cylindrical part 11 of the casing to maintain column 20 concentric with and spaced from the casing 10.

In a preferred embodiment of the invention the column 20 includes an interior I beam 37 which is connected between structure enaging portion 22 and bearing plate 30 to help support the load on column 20.

Figure 2:
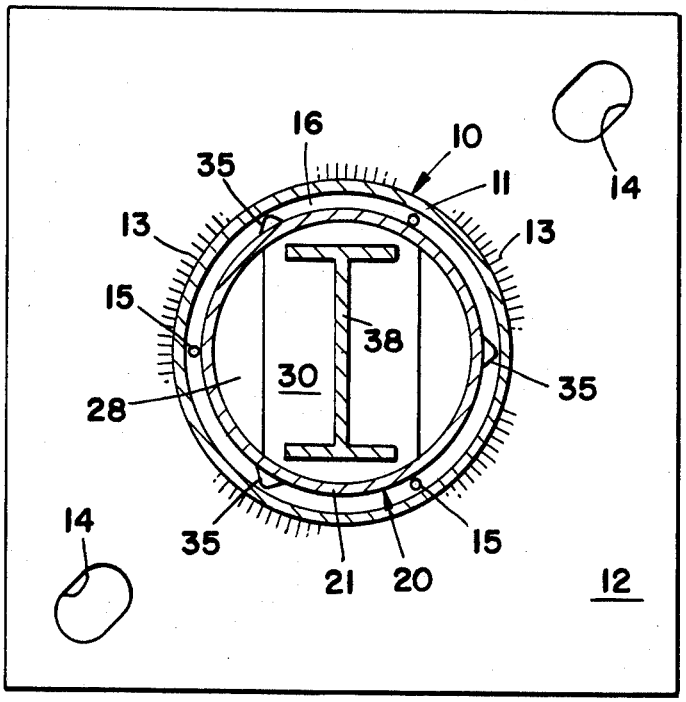
FIG. 2 is a cross-section view of FIG. 1 taken along the line 2—2.

In use the device illustrated in the drawing is selected to be approximately the correct length to reach from the ground to the structure being supported the bottom of column 20 is slightly above the bottom of casing 10. The portion of the earth on which the structure is to be supported is made level beneath ground engaging part 12 and the interior of column 20 is partially filled with flowable granular material such as sand. When casing 10 is in place structure engaging part 22 is fixed to a beam or other supporting portion of the structure by having bolts or screws or other means fasten structure engaging part 22 to the structure to be supported through holes 25. When the structure being supported is level sand will flow from the interior of column 20 beneath bearing plate 30 to form a firm support. The structure may be supported in its level configuration without the use of shims by simply extending column 20 out of casing 10 a sufficient distance to maintain the structure level. It is contemplated that at least three and preferably more self-adjusting devices as illustrated will be employed to support a structure whereby each will bear its share of the load of supporting the structure. It is preferred that the structure be supported by at least four devices such as the one illustrated in FIGS. 1 and 2.

When the structure is constructed to be level and is connected to a number of devices of this invention, settling of the ground beneath one casing will cause that casing to move downwardly along with the lowered earth surface beneath it. Vibrations caused by passing vehicles and even by use of the structure will hasten the process of the casing settling along with the ground level beneath it and will likewise hasten the process of granular material flowing beneath bearing plate 30 of the column to fill the space caused by the descending casing. Use of the structure also causes flexing of beams that not only promote the flow of granular material but packs it tightly beneath the column portion of the device. This action causes each of numerous devices to support approximtely the same portion of the load of the structure and the support the structure at its original, level or orientation even though there may be different degrees of settling of the earth beneath the various supports on which the structure is supported.

What is claimed is:

1. A device that supports a structure above the ground comprising a lower casing element having a planar ground-engaging means and a hollow cylindrical casing of a first diameter connected to said ground engaging means and extending with the axis of the casing element perpendicular to the plane of said ground engaging means, an upper element having a hollow, cylindrical column of a second diameter, said column having an upper end portion with a structure engaging means which is connectable to said structure, bearing plate partially closing a lower end portion of the column which is opposite the upper end portion, an upper passageway formed in the upper end portion of said column for receiving flowable granular material into the upper portion of said column, the inside diameter of said casing being spaced from the outside diameter of said column, first spacing projections extending from said column toward said casing, and second spacing projections extending from said casing towards said column.

2. The device of claim 1 wherein said first spacing projections comprise indentations in the lower rim of said column.

3. The device of claim 1 wherein said second projections comprise indentations in the upper rim of said casing.

4. The device of claim 1 including a support element mounted within said column.

* * * * *